US009481107B2

(12) United States Patent
Meldahl et al.

(10) Patent No.: US 9,481,107 B2
(45) Date of Patent: Nov. 1, 2016

(54) CONCRETE MIXING DRUM FIN STRUCTURE

(71) Applicant: CON-TECH MANUFACTURING INC., Dodge Center, MN (US)

(72) Inventors: Brian R. Meldahl, Brownsdale, MN (US); Jay Attleson, Rochester, MN (US); Garwin B. McNeilus, Dodge Center, MN (US)

(73) Assignee: Con-Tech Manufacturing, Inc., Dodge Center, MN (US)

( * ) Notice: Subject to any disclaimer, the term of this patent is extended or adjusted under 35 U.S.C. 154(b) by 86 days.

(21) Appl. No.: 14/609,736

(22) Filed: Jan. 30, 2015

(65) Prior Publication Data

US 2016/0221219 A1 Aug. 4, 2016

(51) Int. Cl.
*B28C 5/20* (2006.01)
*B28C 5/18* (2006.01)

(52) U.S. Cl.
CPC ..... *B28C 5/1862* (2013.01)

(58) Field of Classification Search
CPC ..... B28C 5/2063
USPC ..... 366/44, 59, 226, 227
See application file for complete search history.

(56) References Cited

U.S. PATENT DOCUMENTS

| | | | | |
|---|---|---|---|---|
| 2,618,472 | A * | 11/1952 | Castendyck | B28C 5/4268 366/44 |
| 4,187,028 | A * | 2/1980 | Pawley | B28C 5/4268 366/44 |
| 5,056,924 | A | 10/1991 | Christenson | |
| 6,149,291 | A | 11/2000 | Christenson | |
| 8,646,965 | B2 | 2/2014 | Datema et al. | |
| 2013/0107656 | A1 * | 5/2013 | Datema | B01F 9/06 366/59 |

FOREIGN PATENT DOCUMENTS

| | | |
|---|---|---|
| GB | 1474873 | 5/1977 |
| WO | WO2013076111 | 5/2013 |

* cited by examiner

*Primary Examiner* — David Sorkin
(74) *Attorney, Agent, or Firm* — Nikolai & Mersereau, P.A.; C. G. Mersereau

(57) ABSTRACT

A dual spiral mixing fin assembly adapted to mix and guide material contained in a rotatable mixing drum of a type used in a transit concrete vehicle mixing system, the assembly includes dual spiral mixing fins extending transversely along a drum mixing space attachable to the inner surface of a mixing drum. The fins are provided with a plurality of spaced large openings for allowing mixed concrete and charged ingredient materials to migrate along a drum mixing space through the openings in both a forward and rearward direction. The fins also have a plurality of spaced small openings that accommodate the passage of cleanout materials along a drum mixing space. A plurality of strut members are attached to forward portions of the mixing fins and adapted to be fixed to the front interior surface of a mixing drum.

8 Claims, 7 Drawing Sheets

CONCRETE MIXING DRUM FIN STRUCTURE

CROSS-REFERENCED TO RELATED APPLICATIONS

Not applicable

STATEMENT REGARDING FEDERALLY SPONSORED RESEARCH OR DEVELOPMENT

Not applicable

BACKGROUND OF THE INVENTION

I. Field of the Invention

The present invention relates to mobile systems carrying rotatable mixing drums for mixing charged ingredient materials and dispensing concrete. More specifically, this invention relates to a helical mixing fin assembly for mixing and moving materials within concrete mixing drums that involves a fin design structure that provides superior mixing of the charged ingredient materials within rotatable drum mixers.

II. Related Art

Concrete mixing trucks are widely used in the construction industry for preparing and transporting concrete mix to desired construction sites. Such trucks feature a large rotatable mixing drum which includes fins or agitators mounted inside for mixing and directing the movement of a concrete mixture therein. Such fins typically have a helical configuration which will tend to mix concrete ingredients when the mixing drum is rotated in a first direction and urge the concrete towards a discharge chute when the mixing drum is turned in an opposite direction.

The mixing or agitation of materials such as concrete in a rotary mixing environment creates a great deal of abrasive friction between the mixing fins, and the interior surface of the drum, with the various abrasive components of the concrete mixture which is being transported. The mixing fins themselves have also typically been constructed of heavy metal plate stock which may be polymer-coated or they may be constructed of a polymeric stock. Mixing fins have even been provided with small mixing holes to aid in blending materials. Such a fin system is shown in U.S. Pat. No. 8,646,965 B2 to Datema et al. However, the very small holes in rather large fins have been found to provide only a very limited benefit and the fins still inhibit any free flow of materials along the drum.

In addition prior fin systems have consisted of a large number of rather short conjoined sections which require a great deal of labor to assembly in the mixing drum. Dual spiral mixing fin structures are also known. A dual spiral mixing fin structure is shown, for example, in U.S. Pat. No. 5,056,924 to Christenson. That type of design is further illustrated in FIGS. 1 and 2.

FIG. 1 is a side elevational view of a mobile system for mixing and dispensing concrete with a portion of the mixing drum wall cut away to expose the fins. The mobile system includes a mixing truck 10 having a cab portion 12 and a rear portion 14 which has a main frame 16. A mixing drum 18 is mounted for rotation on a front support frame 20 and a rear support frame 22, both of which are integral with the main frame 16. A rearward portion of the mixing drum 18 is positioned adjacent a discharge mechanism 24 which includes a funnel for charging concrete components into the mixing drum 18, as well as a portion for discharging mixed concrete into a main chute 26, as is well known in the art. Main chute 26 is supported relative to rear support frame 22 by a pivot joint 28 which, in turn, enables main chute 26 to be positioned over a set of forms or other desired location for use of the mixed concrete. As may be seen in FIGS. 1 and 2, mixing drum 18 includes a front head cone 31 and front cone 30, a belly or crossover portion 32, a big cone portion 34 and a rear tail cone portion 35 which terminates at the end of truck 10 and which is proximate the discharge mechanism 24, which is supported by rear support frame 22. A conventional dual helical or spiral mixing fin assembly 36 is mounted to an inner surface of an outer wall and extends transversely into the mixing space of mixing drum 18.

The fin assembly 36 includes a first rearwardly curving segment 37, a second forwardly curved fin segment 39 and a transitional fin portion 41 which connects the rearwardly curving segment 37 and the forwardly curving segment 39. As can be seen from the figures, a concrete mixture will be agitated by the fin segments 37, 39 and 41 when mixing drum 18 is caused to rotate in a first direction, while the fin segments will urge the mixture toward the discharge mechanism 24 when the rotational direction of the mixing drum 18 is reversed. The forward curving fin segment 39 acts to help lift and toss the mixture toward the middle of the drum 18 when the drum 18 is rotated to mix the material. The various sections of spiral fin assembly 36 are secured in the mixing drum 18 in a conventional manner.

As can be seen, particularly in FIG. 1, concrete mixing drums of conventional design have had a mixing fin assembly 36 which forms spiral mixing flights located symmetrically opposite and rotated 180° apart. The two flights are usually identical to each other in most conventional designs, especially in the discharge portion. As stated, the rotation of the drum in a given direction allows material to be loaded into the drum and agitated, while rotation of the drum in the opposite direction will discharge the concrete as it slides off the flighting toward the outlet end.

A long standing problem in the art of concrete drum mixing technology has been associated with the forward and rearward migration of the materials during the mixing and discharge processes. The material must move up and over the mixing fins as it moves forward or aft in the drum this causes increased wear to both the mixing fins and the drum inner wall. The solid fins also present an impediment to the drum clean out process and the removal of residual concrete after use.

SUMMARY OF THE INVENTION

By means of the present invention, there is provided a mixing fin assembly adapted to mix and guide materials contained in a rotatable mixing drum of a type used in a transit concrete vehicle mixing system. The mixing fin assembly includes a dual spiral mixing fin system designed to extend transversely into a drum mixing space. The fin assembly is preferably constructed of elongate shaped steel sections that are conjoined to form the dual spiral system. The fin sections are fixed to the inner wall surface of the drum as by welding.

The present invention provides a dual spiral mixing fin assembly that promotes forward and rearward flow of materials and improves the clean out process. The mixing fins of the fin assembly of the present invention include a row of spaced large openings which enable large amounts of the material in the drum to move forward and rearward more easily migrating along the drum through the openings. While the openings may be any convenient size and shape, it has been found that round openings having a diameter from about 3" to 6" work well. The term "larger opening" as used herein defines an opening at least equivalent to a 3 inch circle. The mixing fins also are provided with a set of spaced small openings that are staggered from the large openings and located closer to the drum wall. These openings are preferably round openings in sizes from about 1½ to 2½ inches in diameter. The term "small opening" as used herein defines an opening equal to a circle 2½ inches or less in diameter. One embodiment used openings about 2 inches in diameter. The smaller openings are provided primarily to allow the free passage of water and cleanout chemicals along the drum to enhance the clean out process.

The forward aspects of the fin spirals are provided with a pair of spaced struts which are connected to the front of the drum. These heavy-duty members serve to break up clumps of material that may form during mixing. The struts are heavy-duty assemblies that are preferably T-shaped with the cross member of the T having roughened edges and remaining member having spaced openings.

BRIEF DESCRIPTION OF THE DRAWINGS

In the drawings wherein like numerals depict like parts

DETAILED DESCRIPTION

The following description details one or more exemplary embodiments illustrating the present invention. It should be noted that the detailed descriptions are intended by way of example only and are not intended to limit the scope of the invention in any respect. It will be further understood that the embodiments of the invention can be modified by those skilled in the art while remaining in keeping with the inventive concepts.

Figure 1:
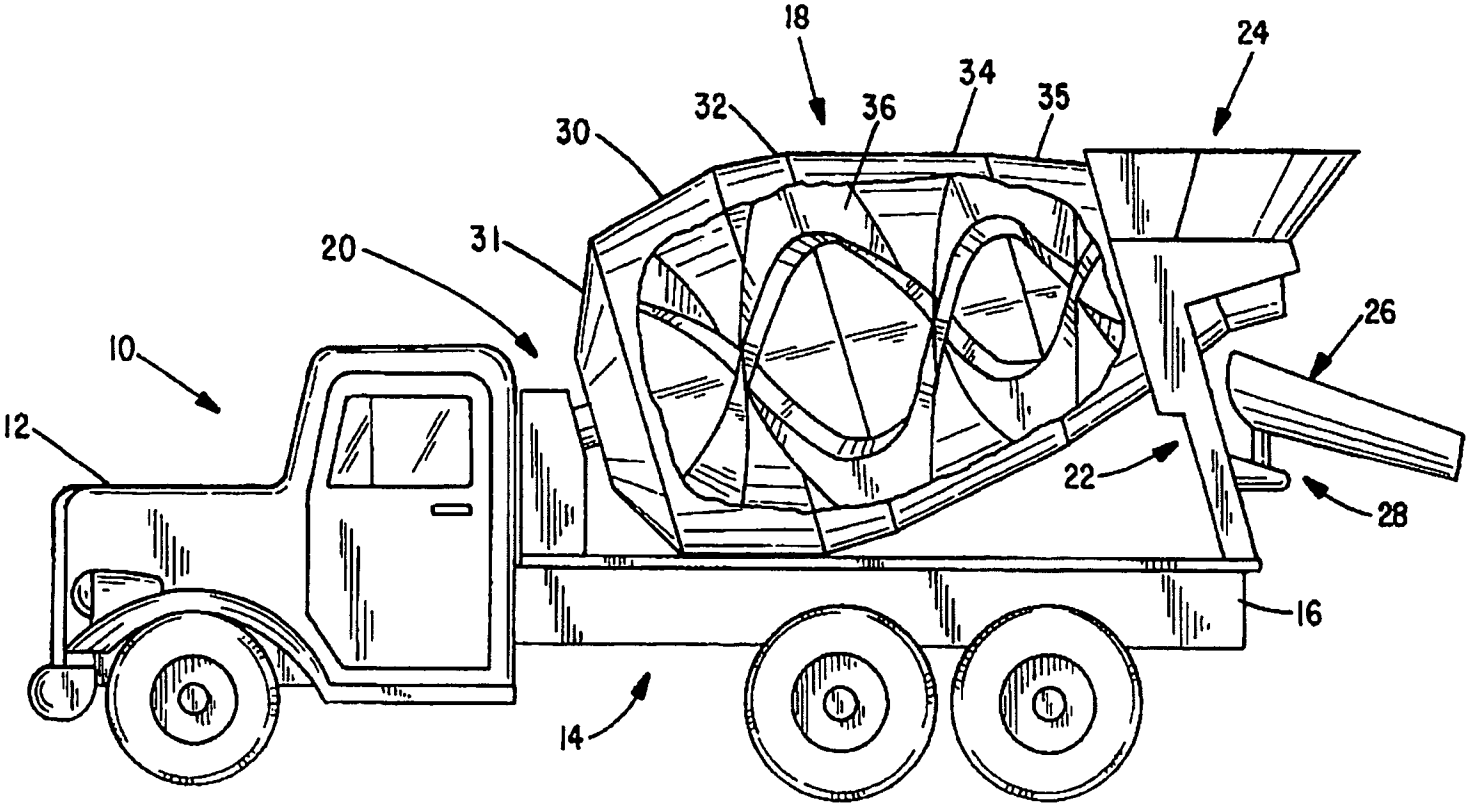
FIG. 1 (PRIOR ART)
FIG. 1 is a side elevational view with parts cut away to show the fin pattern of a mobile system for mixing and dispensing concrete according to a conventional design.
Figure 2:
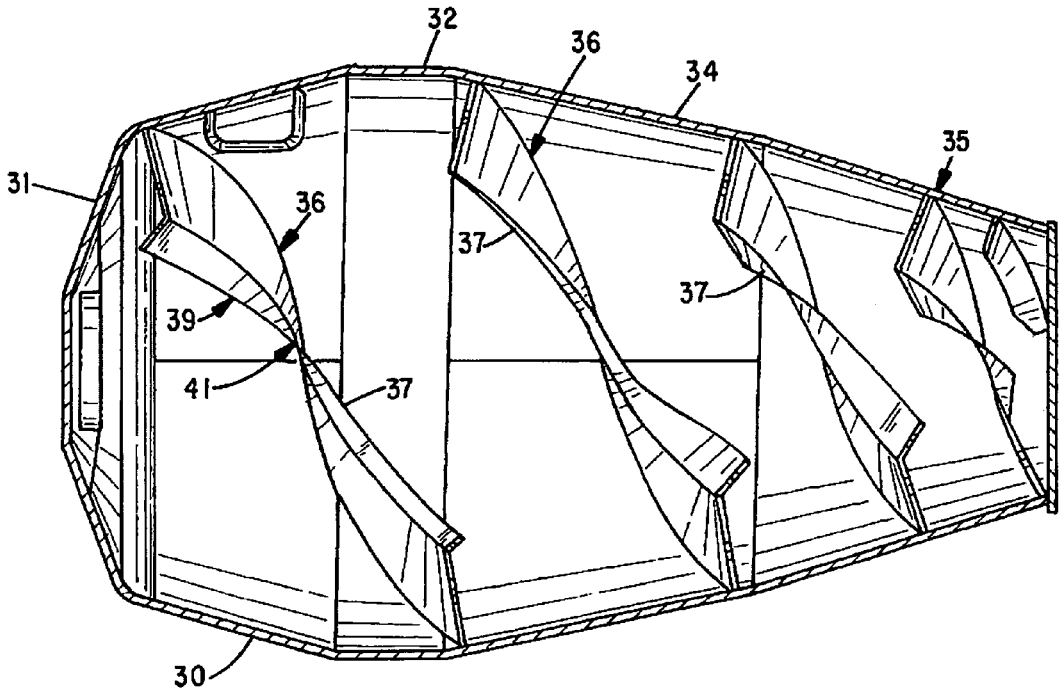
FIG. 2 (PRIOR ART)
FIG. 2 is a fragmentary elevational view of the mixing drum of FIG. 1 showing the drum cut in half through the central axis with the half shell and corresponding internal flight portions removed.

The pertinent parts of a typical conventional mobile system for mixing and dispensing concrete including the vehicle, mixing drum mounting arrangement and general dual fin system are illustrated in FIGS. 1 and 2 with the earlier description of related art.

The concepts illustrated in FIGS. 3-6 of the drawings show an illustrative detailed embodiment of the present inventive concept.

Figure 3:
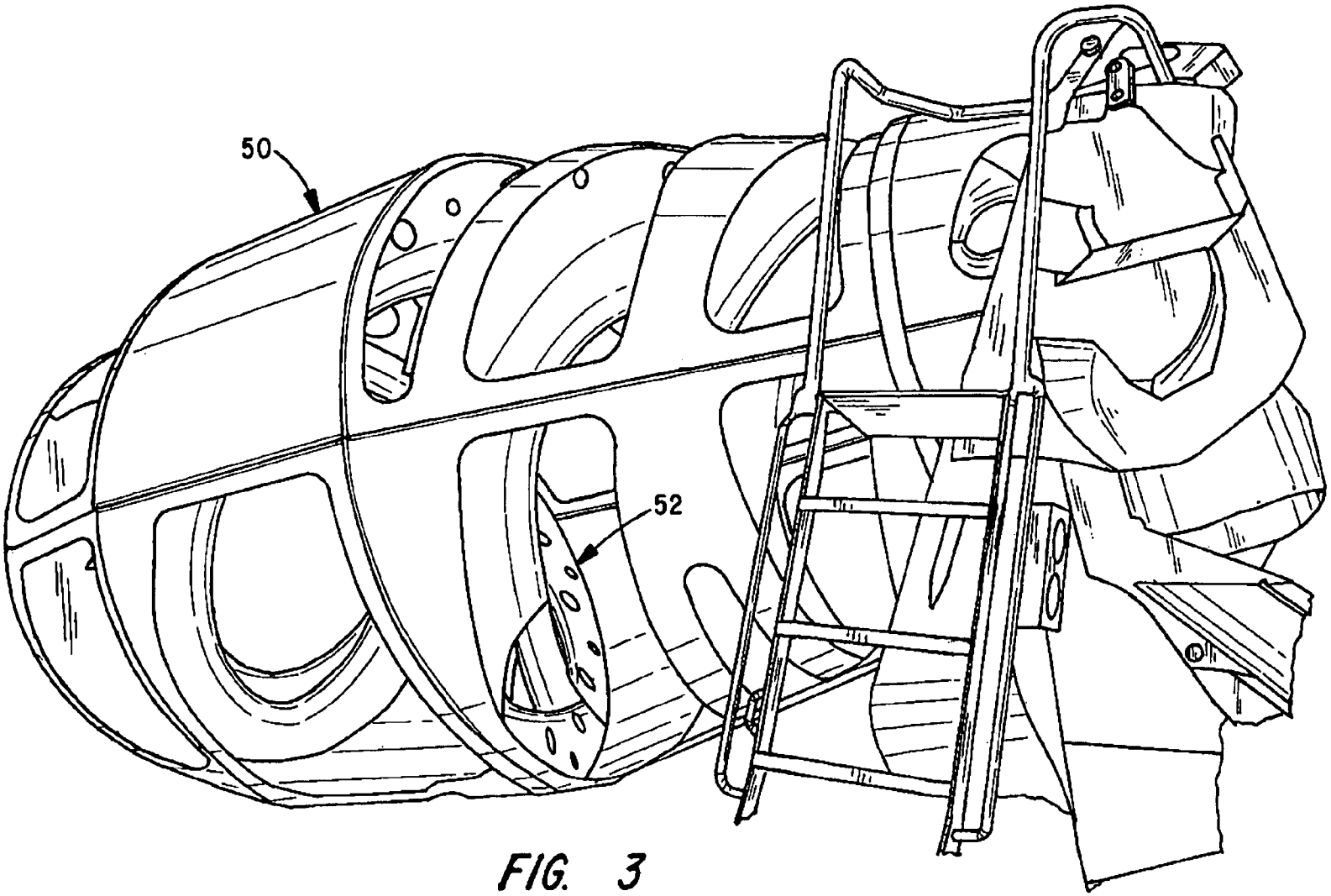
FIG. 3 is a perspective view of a model mixing drum with parts cut away exposing an internal mixing fin in accordance with the present invention.
Figure 4:
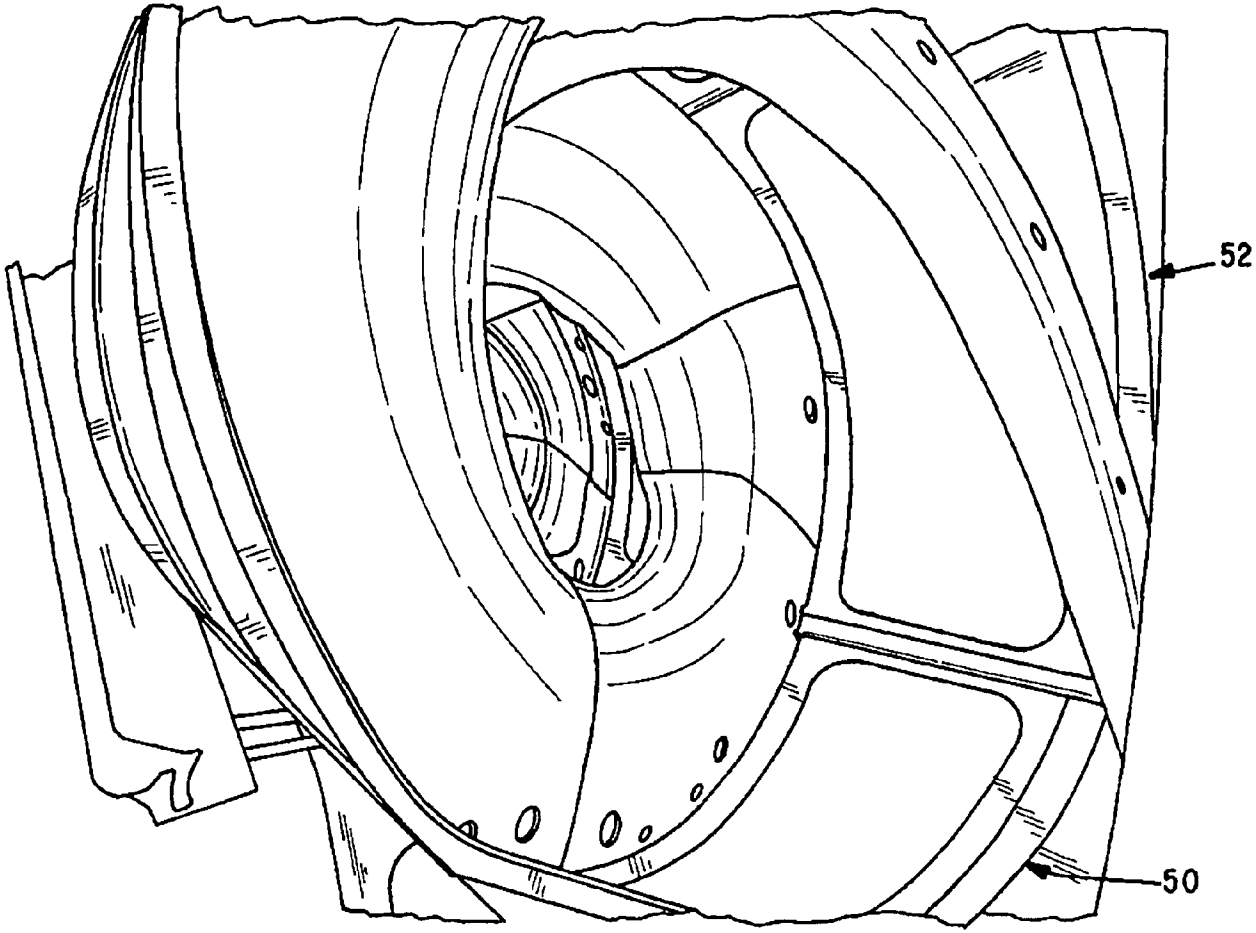
FIG. 4 is a perspective view that depicts a portion of the helical fin of FIG. 3.

FIG. 3 is a perspective view of a model of a mixing drum 50 with numerous parts cut away to expose an internal helical mixing fin system mounted therein, part of which is shown at 52. FIG. 4 depicts a further portion of the helical fin system in the model drum.

Figure 5:
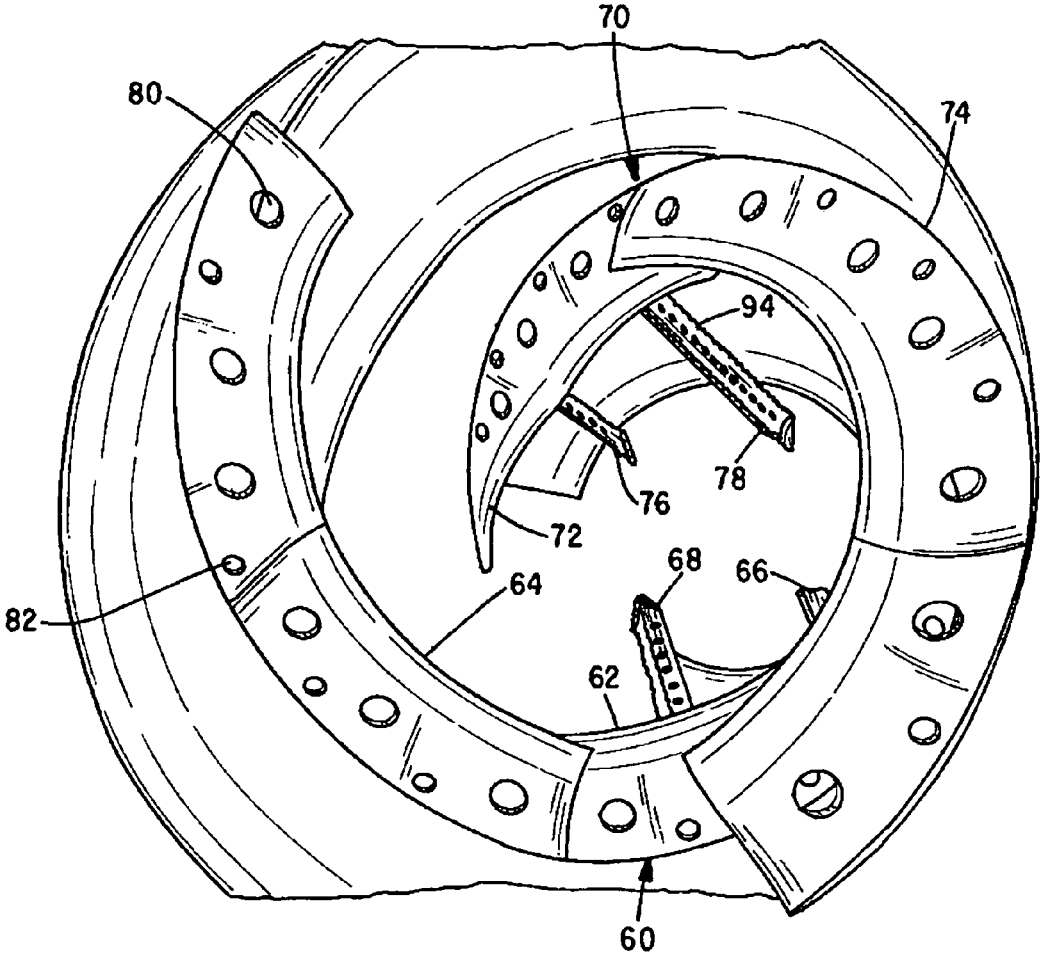
FIG. 5 is a perspective view that depicts forward sections of the dual helix mixing fin of the invention with the forward struts.
Figure 7A:
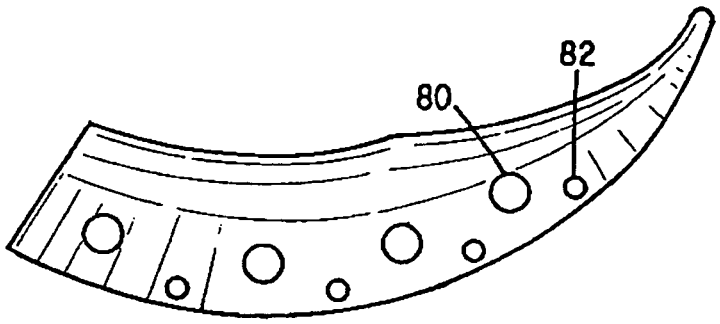
FIGS. 7A-7C are fragmentary views of mixing fin end sections depicting alternate opening shapes
Figure 7B:
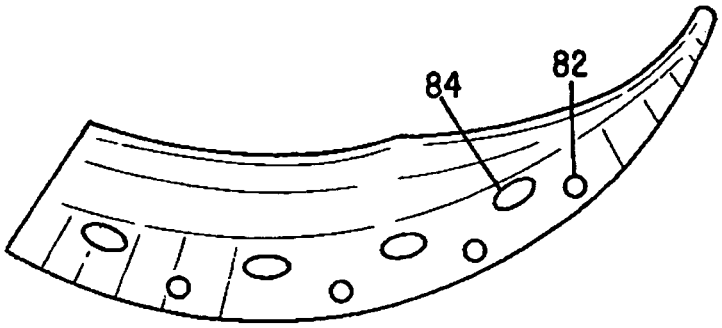
Figure 7C:
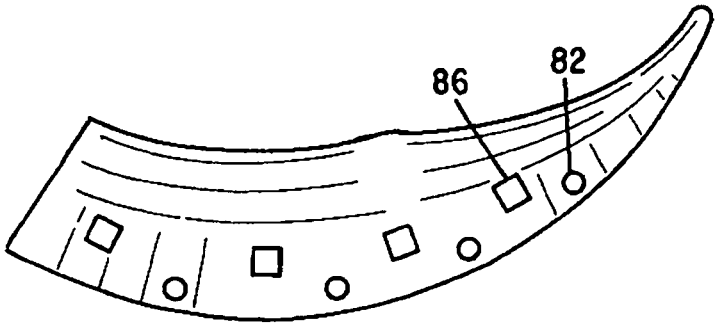

FIG. 5 is a perspective view that depicts fragments of the forward sections of a dual helix mixing fin system in accordance with the invention, including a forward helix with consecutive sections 62 and 64 with forward struts 66 and 68. The forward helix 60 is overlapped by a second helix 70, including sections 72 and 74 with forward struts 76 and 78. Both helical fins are provided with a plurality of large openings 80 arranged in spaced relation aligned along the fin sections just below the midpoint of the width of the fin sections. Both helical fins are also provided with a plurality of small openings 82 arranged in spaced relation and aligned along the fin sections below and in staggered relation to the array of large openings. FIGS. 7A-7C show alternate shapes of opening that might be employed. In addition to the round openings 80, oval openings 84 are shown in FIG. 7B and square or rectangular openings 86 are depicted in FIG. 7C. The designation "below" is meant to refer to a direction toward the inner wall of the mixing drum to which a fin is fixed, The openings are provided along the entire length of the helical fin arrangement.

The series or arrays of spaced openings along the length of the mixing fins greatly enhance the mixing characteristics of the mixing system. The large openings enable easy migration of the ingredients along the drum as a larger proportion of the material can move through the openings instead of being forced to go over the fins. While any shape and suitable size of openings can be employed, it has been found that round openings about 3 inches to 6 inches in diameter work well. The large openings are generally spaced about 12 inches by 24 inches apart. One successful embodiment employs 4 inch diameter openings about 12 inches to 24 inches apart.

Figure 6:
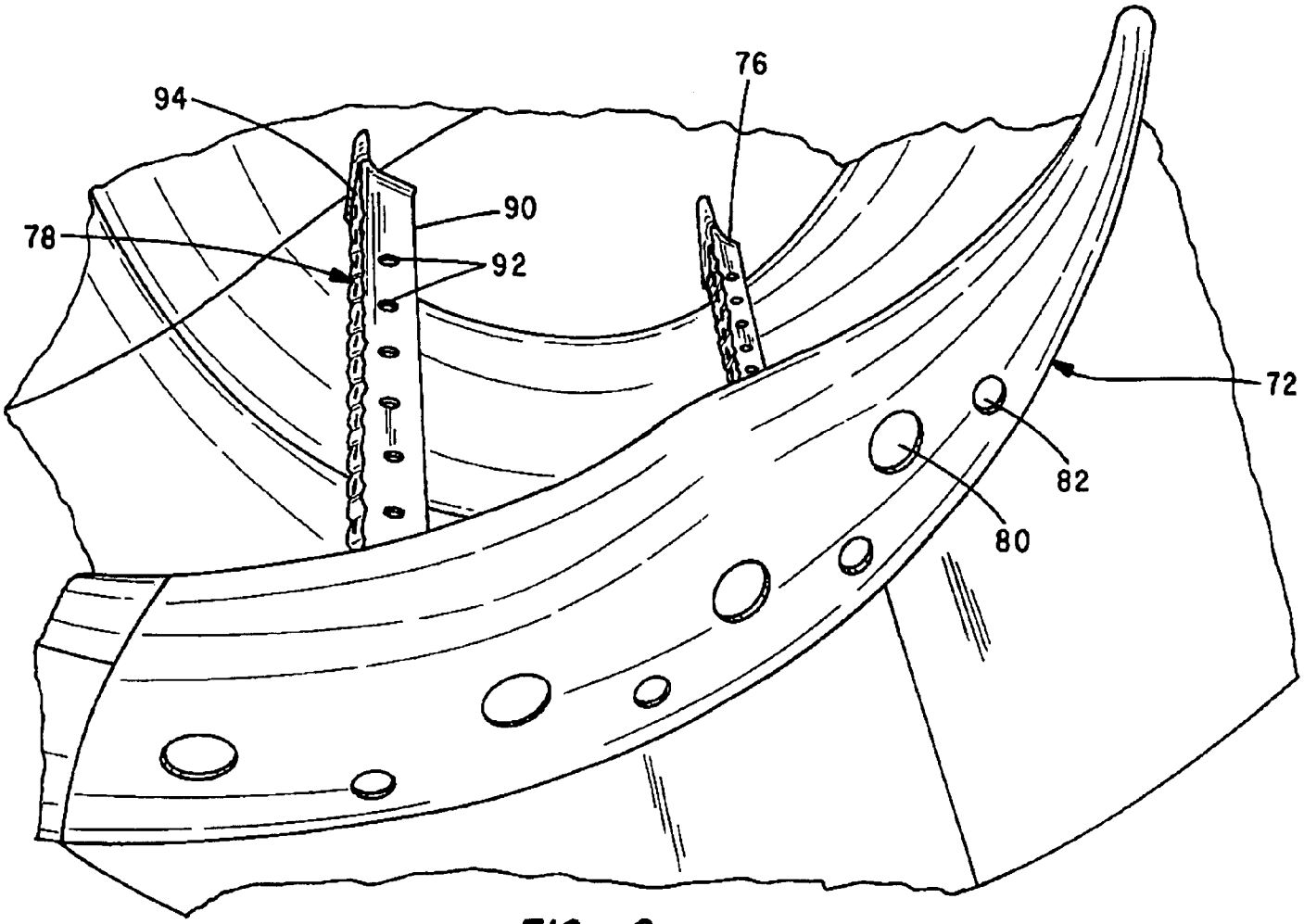
FIG. 6 is an enlarged fragmentary view of the forward portion of a mixing fin in accordance with the invention.

The small openings are provided to assist in enabling cleanout fluids to more easily flow along the drum making the cleanout aspect of the process much easier. The smaller openings may be from about 1½ inches to 2½ inches in diameter spaced as desired. One successful embodiment used 2 inch openings spaced about 12 inches to 24 inches apart, As best seen in FIG. 6, the struts as at 76 and 78 are generally T-shaped members. Strut 78 includes a support member 90 provided with a plurality of spaced holes 92 and a cross member 94 with roughened edges, The struts are very effective in breaking up clumps and chunks of material during mixing.

The dual helical mixing fin system of the invention has been found to promote faster and more efficient mixing than systems with a conventional fin system without openings along the fins. In addition, the openings reduce wear on both the fins and the interior drum walls to give the mixing drums a longer average life.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. A dual spiral mixing fin assembly adapted to mix and guide material contained in a rotatable mixing drum of a type used in a transit concrete vehicle mixing system, the assembly comprising:

(a) dual spiral metal mixing fins having an upper edge and a lower edge and extending transversely along a mixing space of a mixing drum, the lower edge being attachable to an inner drum surface;

(b) wherein the dual spiral mixing fins comprise a plurality of large openings spaced apart along the fins for allowing mixed concrete and ingredient materials to migrate along a drum mixing space through the openings in the fins in both a forward and rearward direction;

(c) wherein the dual spiral mixing fins further comprise a plurality of small openings spaced apart along the fins and spaced from the lower edge but closer to the lower edge than the large openings that accommodate the passage of cleanout materials along a drum mixing space; and (d) a plurality of strut members attached to forward portions of the mixing fins and adapted to be fixed to the front interior surface of a mixing drum.

2. A dual spiral mixing fin assembly as in claim 1 wherein said spiral fins are adapted to be welded to the inner drum surface.

3. A dual spiral mixing fin assembly as in claim 1 wherein said mixing fins comprise a plurality of conjoined sections.

4. A dual spiral mixing fin assembly as in claim 1 wherein said large openings are selected from shapes consisting of round, oval, square and rectangular.

5. A dual spiral mixing fin assembly as in claim 1 wherein said large openings are round openings from about 3 inches to about 6 inches in diameter.

6. A dual spiral mixing fin assembly as in claim 1 wherein said small openings are from 1½ to 2½ inches in diameter.

7. A dual spiral mixing fin assembly as in claim 1 wherein said large openings are round openings 4 inches in diameter and wherein said small openings are round openings 2 inches in diameter.

8. A dual spiral mixing fin assembly as in claim 1 wherein said strut members are T-shapes.

* * * * *